US011475801B2

(12) United States Patent
Konow

(10) Patent No.: US 11,475,801 B2
(45) Date of Patent: Oct. 18, 2022

(54) ELECTRONIC SHELF LABEL AND SIGN

(71) Applicant: Pricer AB, Stockholm (SE)

(72) Inventor: Johan von Konow, Stockholm (SE)

(73) Assignee: PRICER AB, Stockholm (SE)

( * ) Notice: Subject to any disclaimer, the term of this patent is extended or adjusted under 35 U.S.C. 154(b) by 0 days.

(21) Appl. No.: 16/834,592

(22) Filed: Mar. 30, 2020

(65) Prior Publication Data

US 2020/0320905 A1 Oct. 8, 2020

(30) Foreign Application Priority Data

Apr. 2, 2019 (SE) ..... 1950406-7

(51) Int. Cl.
*G09F 3/20* (2006.01)

(52) U.S. Cl.
CPC ..... *G09F 3/208* (2013.01); *G09F 3/204* (2013.01); *G09G 2380/04* (2013.01)

(58) Field of Classification Search
CPC ..... G09F 3/208; G09F 3/204; G09G 2380/04; A47G 1/065
See application file for complete search history.

(56) References Cited

U.S. PATENT DOCUMENTS 905,189 A * 12/1908 Hyke ..... E04F 15/02 52/582.1
5,095,412 A * 3/1992 French ..... E04C 2/521 362/153
5,771,005 A 6/1998 Goodwin, III
6,000,611 A 12/1999 Dalton et al.
6,621,407 B1 9/2003 Goodwin, III
7,958,688 B2 * 6/2011 Vilar Llop ..... E04F 15/02022 52/582.2
10,064,504 B2 * 9/2018 Hogrefe ..... F16M 13/02
2007/0013479 A1 1/2007 Goel et al.
2008/0079538 A1 4/2008 Davis
2011/0179734 A1 * 7/2011 Shaffer ..... B32B 3/06 52/309.1
2011/0239509 A1 10/2011 Horikiri
2011/0286195 A1 11/2011 Horikiri et al.
(Continued)

FOREIGN PATENT DOCUMENTS

FR 3051587 A1 11/2017
WO 2014007737 A1 1/2014

OTHER PUBLICATIONS

Swedish Search Report from corresponding Swedish Application 1950406-7 dated Oct. 22, 2019, 4 pages.
(Continued)

*Primary Examiner* — Cassandra Davis
(74) *Attorney, Agent, or Firm* — Cooper Legal Group, LLC; Ronald M. Kachmarik

(57) ABSTRACT

An electronic shelf label for displaying information. The electronic shelf label includes: a casing including at least one side surface, a front side and a back side; an information display area arranged in the front side; and at least two curved recesses arranged at a distance from each other in the at least one side surface, the at least two recesses are intended for attachment of an external information display sign to the electronic shelf label. Also, an information display sign for use in combination with the electronic shelf label.

9 Claims, 4 Drawing Sheets

(56) References Cited

U.S. PATENT DOCUMENTS

| | | | | |
|---|---|---|---|---|
| 2012/0144706 | A1* | 6/2012 | Engelby | G09F 7/18 40/584 |
| 2014/0158846 | A1 | 6/2014 | Nicolis | |
| 2014/0197923 | A1* | 7/2014 | Engelby | G09F 3/208 340/6.1 |
| 2015/0170550 | A1* | 6/2015 | Jubro | G09F 3/02 40/662 |

OTHER PUBLICATIONS

Corresponding Canadian Application No. 3077766, Canadian Office action dated Oct. 14, 2021.

* cited by examiner

ELECTRONIC SHELF LABEL AND SIGN

FIELD OF THE INVENTION

The present invention relates to electronic shelf label for displaying information, and an information display sign for use in combination with the shelf label.

BACKGROUND OF THE INVENTION

In many different types of stores, for example supermarkets etc, electronic shelf labels, also named ESLs, are used for displaying information about the different products offered in the store. The information displayed is for example the name and type of product as well as the price for each of the products.

The electronic shelf labels are communicating with a central control unit that makes it possible to frequently update, and change the information displayed on the labels which saves a considerable amount of time for the persons working in the store, especially if the number of different products sold in the store is high. As an example, a supermarket offers between 5000 and 20000 different products.

The electronic shelf labels used in the store are typically of the same type and arranged side by side in a rail along the forward edge of the shelves or desks in the store.

However, there is frequently a desire to be able to show additional information directed to a specific product such as for example an additional red sign if a product is for sale to a reduced price, a sign identifying if a certain product is produced in an environmentally friendly way or special offers to loyal customers etc.

Today, these signs/flags are made of a sheet of paper or plastic material that is attached to fastening means arranged on the outside periphery of the shelf label casing. However, the signs/flags tend to very easily fall off from the ESL.

There is consequently a need for an improved electronic shelf label (ESL) that makes it possible to add external signs/flags to display additional information together with the ESL.

SUMMARY OF THE INVENTION

The present invention, defined in the appended claims, relates to an electronic shelf label for displaying information that to at least some extent fulfills the need defined above.

The electronic shelf label according to the invention comprises:

a casing comprising at least one side surface, a front side and a back side;

an information display area arranged in the front side; and at least two curved recesses arranged at a distance from each other in said at least one side surface, said at least two recesses are intended for attachment of an external information display sign to the electronic shelf label.

The claimed electronic shelf label fulfils the needs defined above since the curved recesses extending within the shelf label casing makes it possible to attach an information display sign in a reliable and very elegant way to the label casing. The curved recesses ensure a resistant and strong fastening of an information display sign without requiring external fastening means on the ESL casing that increases the overall size of the ESL and/or increasing the complexity of the casing.

Furthermore, the curved recesses make it possible to attach information display signs of different size and shape and provide additional information or decoration to the electronic shelf label.

A further advantage with the claimed invention is that the additional information display sign is connected directly to the electric shelf label which ensures that if the electronic shelf label is moved, the information display sign is moved together with the electronic shelf label.

In one embodiment of the electronic shelf label, the two recesses comprises an opening arranged in the side surface and a curved section extending within the casing. This embodiment of the electronic shelf label makes it possible to design the casing with an simple and smooth characteristic since only the openings are visible on the outside of the casing.

In one embodiment of the electronic shelf label, the two recesses are arranged along a substantially straight line substantially parallel to the front side of the electronic shelf label, and said curved recesses extend in a plane substantially parallel to the front side. This embodiment of the electronic shelf label used in combination with a substantially flat information display sign result in that the information display sign is arranged adjacent and parallel to to the display area of the electronic shelf label.

In one embodiment of the electronic shelf label, the two recesses are curved outwards such that the distance between the two recesses is increased along the recesses. This embodiment of the electronic shelf label provides a reliable and strong securing of the information display sign to the electronic shelf label.

In one embodiment of the electronic shelf label, the casing comprises a first side surface, a second side surface, an upper side and a lower side, and said two recesses are arranged in the first or second side surface.

In one embodiment of the electronic shelf label, the electronic shelf label comprises two curved recesses arranged in one or more of said first, second, upper or lower side. Pairs of curved recesses arranged in the different sides of the casing makes it possible to attached further additional signs to the electronic shelf label at the same time and consequently makes it possible to increase the additional area for displaying information.

The invention furthermore relates to an information display sign for use in combination with the electronic shelf label defined above. The information display sign comprises:

an information display surface surrounded by at least one circumferential edge; and at least two curved protrusions extending from said at least one circumferential edge, said protrusions are arranged at a distance from each other corresponding to the distance between said at least two recesses in the electronic shelf label and has a shape corresponding to the curved recesses such that the sign could be secured to the electronic shelf label by arranging the two protrusions in the two recesses.

In one embodiment of the information display sign, the sign is made of a sheet of a paper or plastic material. This embodiment provides a very simple and cost effective solution to provide the additional display area adjacent to the electronic shelf label. A further advantage with this embodiment is that assembly/disassembly is facilitated since the sign, due to the slightly flexible characteristics of the sheet of a plastic or paper material, could be bent such that the distance between the two protrusions is adjusted to correspond to the distance between the two recesses in the electronic shelf label.

In one embodiment of the information display sign, the information display surface and the curved protrusions are substantially flat and extending in a common plane intended to be arranged substantially parallel to the information display area on the electronic shelf label. This embodiment ensures that the openings in the casing could be designed small with limited area.

In one embodiment of the information display sign, the two protrusions are curved outwards such that the distance between the two recesses in the plane of the sign is increased along the protrusions to provide a reliable attachment of the sign to the casing. Furthermore, the assembly/disassembly of the sign is facilitated by bending the sign such that the distance between the outer ends of the two protrusions is reduced to correspond to the openings of the protrusions in the electronic shelf label casing. Once the two protrusions are fitted in the recesses the force applied on the sign is removed an the sign, and the two protrusions, returns to the original flat shape an the protrusions are locked in the respective recess.

The invention furthermore relates to an arrangement. The arrangement comprises the electronic shelf label according to anyone of the preceding embodiments. The arrangement further comprises an information display sign for use in combination with the electronic shelf label, the sign comprises an information display surface surrounded by at least one circumferential edge and at least two curved protrusions extending from said at least one circumferential edge. The protrusions are arranged at a distance from each other corresponding to the distance between said at least two recesses in the electronic shelf label and has a shape corresponding to the curved recesses such that the sign could be secured to the electronic shelf label by arranging the two protrusions in the two recesses.

The different described embodiments of the arrangement could of course be combined in different ways without departing from the scope of the invention that will be described more in detail in the detailed description.

BRIEF DESCRIPTION OF THE DRAWINGS

Different embodiments of the electronic shelf label and the information display sign according to the invention are illustrated in the appended figures.

DETAILED DESCRIPTION OF EMBODIMENTS

Figure 1:
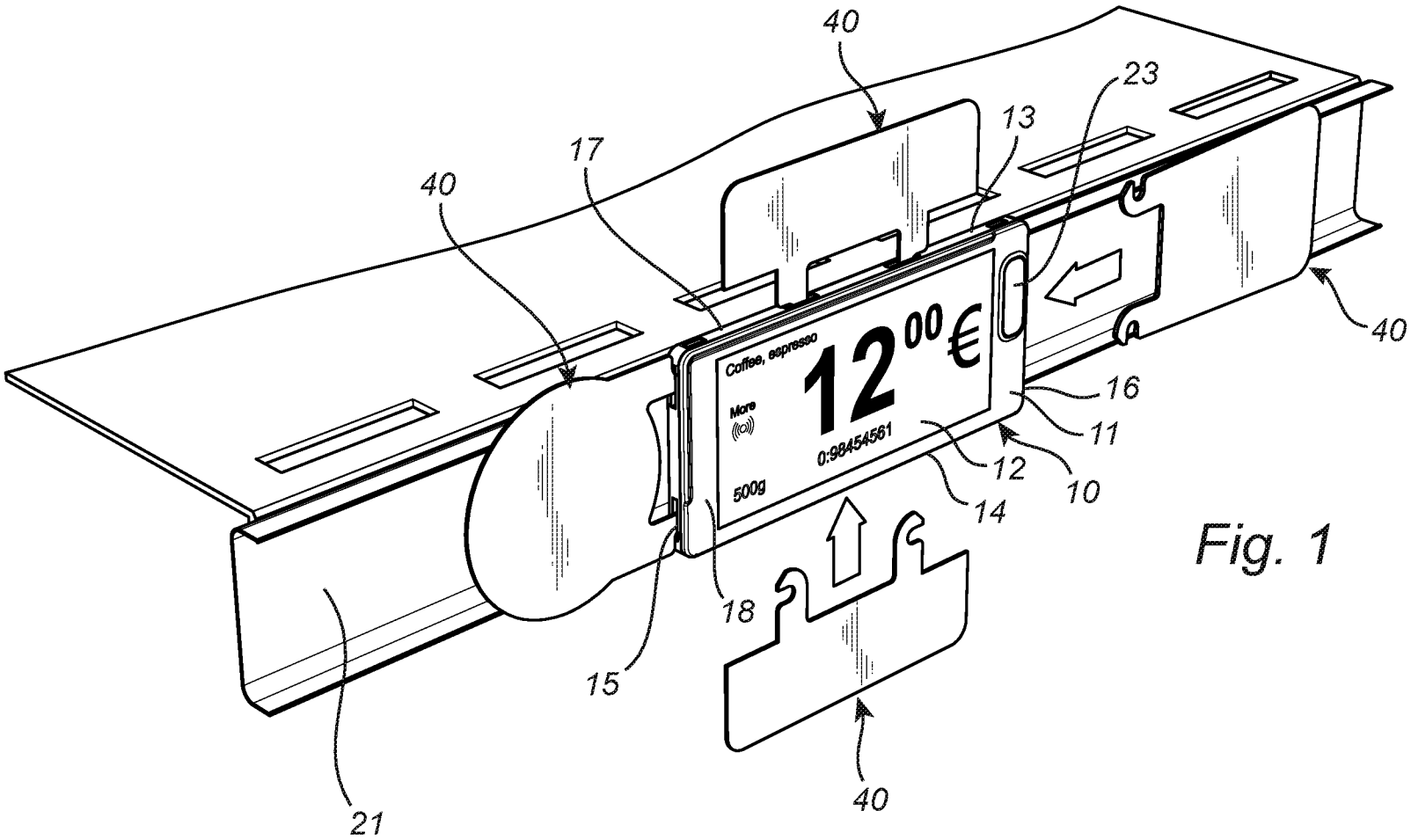
FIG. 1 illustrates a perspective view of an electronic shelf label fitted in a guidrail along the forward edge of a shelf.

In FIG. 1, a perspective view of an electronic shelf label (ESL) is illustrated. The ESL 10 comprises a casing 11 and a display area 12.

The casing is substantially rectangular with an upper 13 and a lower side 14 arranged parallel to each other, two side surfaces 15 and 16, and a front 18 and back 17 side. The front side is substantially flat and comprises the display area 12. The casing 11 is made of at least a first and a second casing section in order to facilitate the manufacturing of the casing and the assembly and mounting of the different components within the casing 11. The casing is for example made of a plastic material that provides the desired structural strength as well as the desired appearance of the ESL. The display area 12 is preferably as large as possible to improve the visibility of the displayed information. The layout on the display is adapted to the specific use of the ESL.

Along the upper and lower side of the ESL casing, elongated protrusions, not illustrated, are extending. The elongated protrusions make it possible to fasten the ESL in an elongated rail 21 arranged along the forward edge of a shelf 22 or desk. The rail 21 has a C-shaped cross section and encloses the back side of the ESL and grip around the elongated protrusions when the ESL is fastened in the intended position along the rail to maintain the ESL in the rail.

In the front side of the ESL, means 23 for communication between the ESL and a central control system is arranged. In the illustrated embodiment of the ESL, this communication involves means for infra red optical communication with one, or more, in the store centrally arranged control unit. Other alternatives for communication between the ESL and the central control system are also possible and the means for communication are then modified or adapted to the desired system for communication. In a further embodiment of an ESL, the means for communication could be arranged in the side surfaces or integrated within the casing as long as the desired contact between the ESL and the central control unit is achieved.

The ESL furthermore comprises a battery arranged in a cavity within the casing 11. The size and shape of the cavity corresponds to the size and shape of the battery. The number and size of the battery, or batteries, could however be changed to adapt the ESL to specific needs.

Figure 2A:
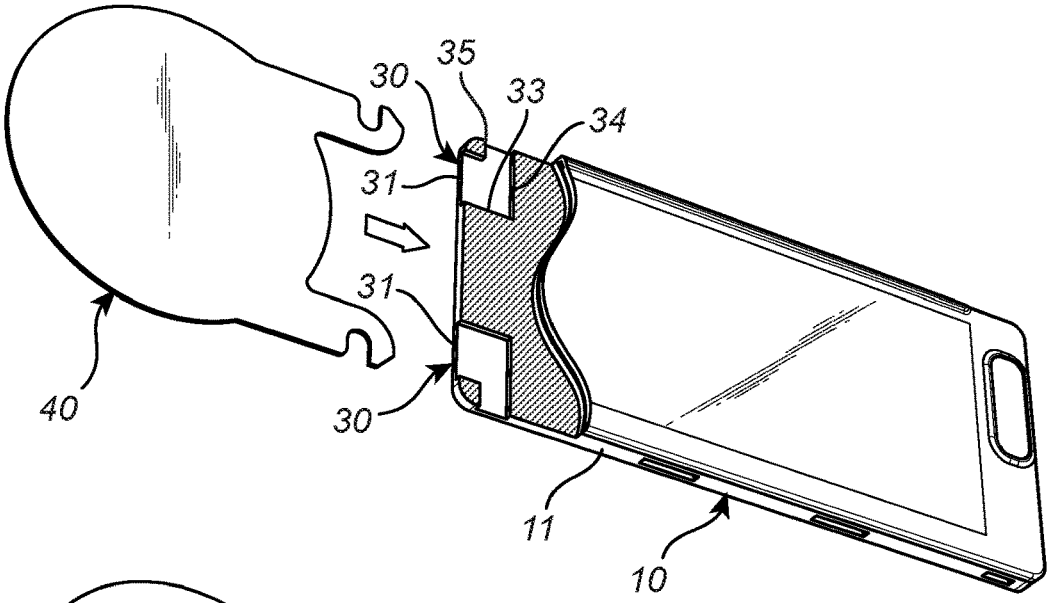
FIG. 2*a-c* illustrates a schematic illustration of the interior of an electronic shelf label and the attachment of an information display sign.
Figure 2B:
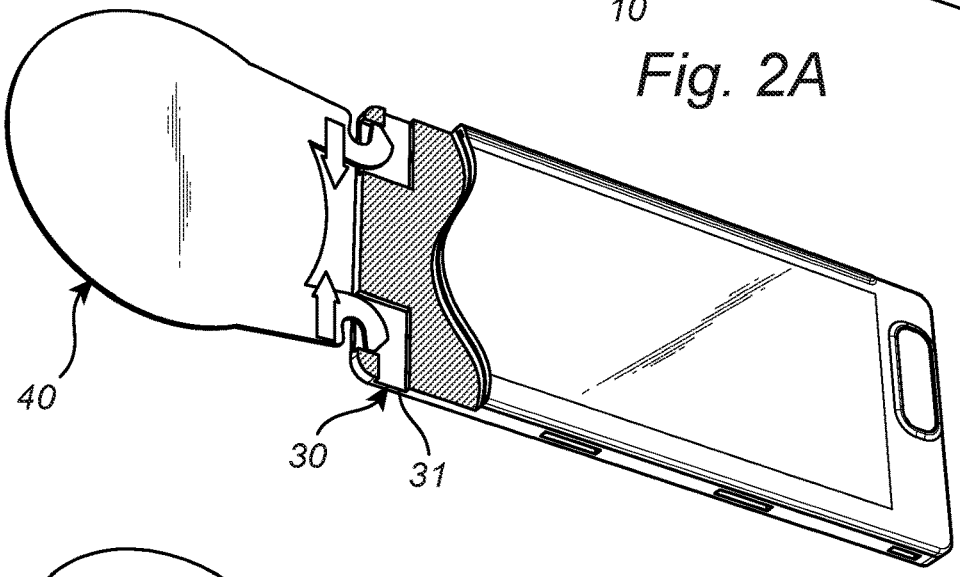
Figure 2C:
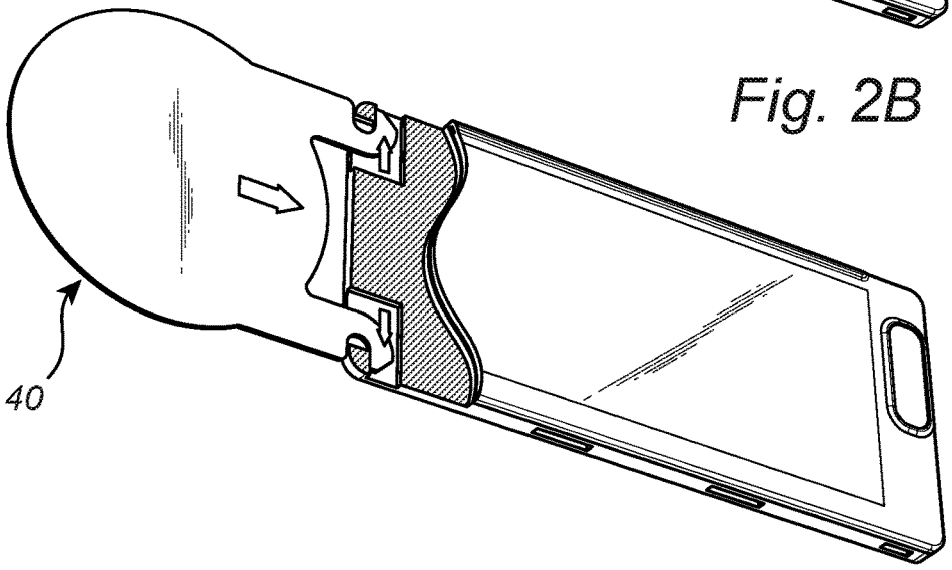
Figure 3A:
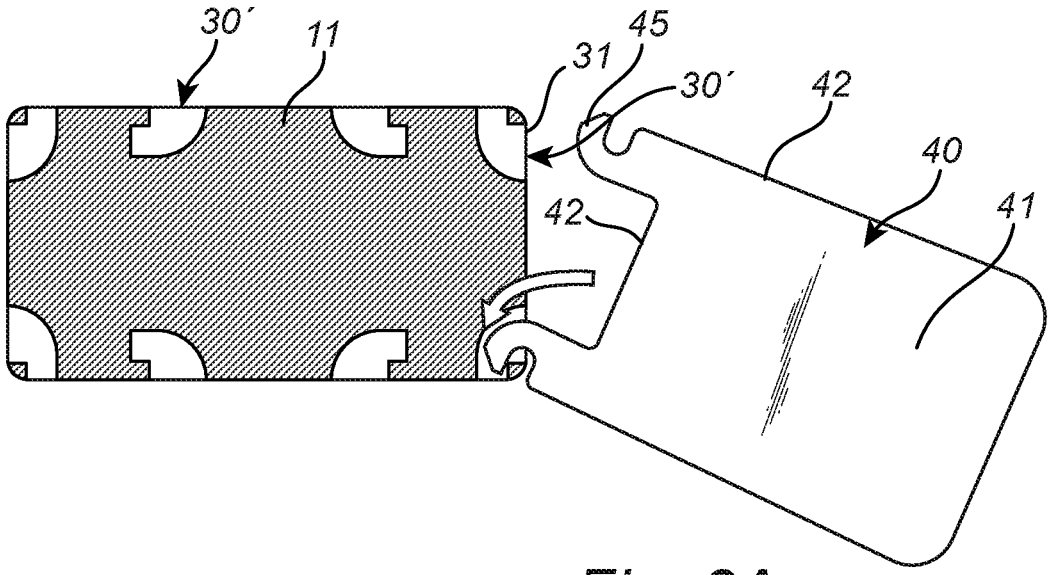
FIG. 3*a-b* illustrates a cross sectional view of an electronic shelf label and the attachment of an information display sign
Figure 3B:
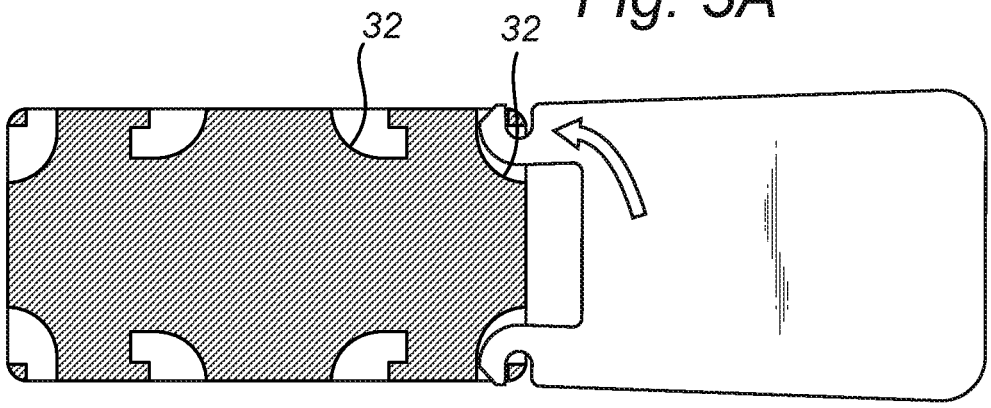
Figure 4A:
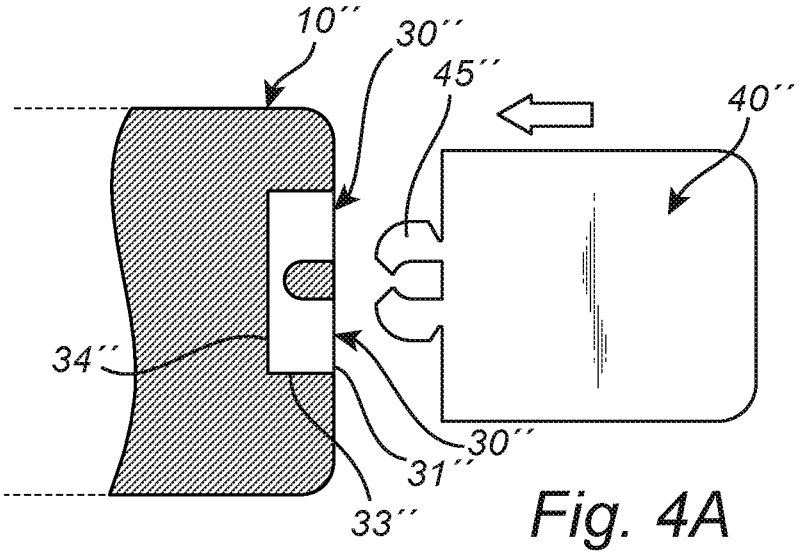
FIG. 4*a-c* illustrates a cross sectional view of a second embodiment of an electronic shelf label and the attachment of an information display sign adapted for this embodiment.
Figure 4B:
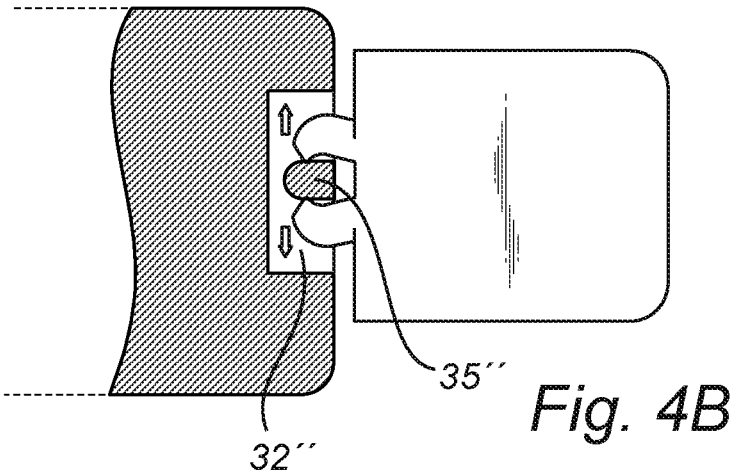
Figure 4C:
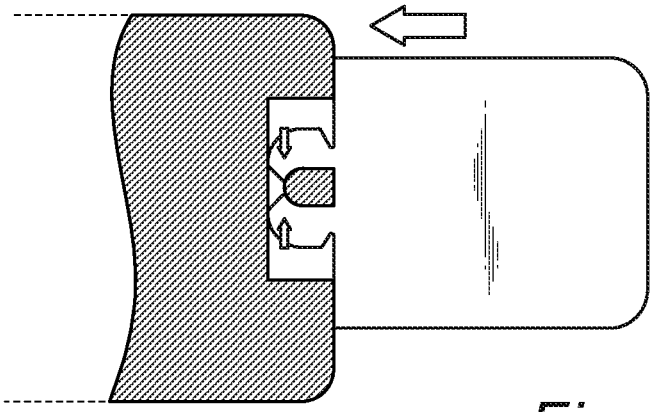

In the ESL 10 according to the invention, at least two curved recesses 30, illustrated in FIGS. 2, 3 and 4, are arranged at a distance from each other in one or more of the side surfaces, the lower and upper side of the casing 11. The at least two recesses 30 are intended for attachment of an external information display sign 40 to the electronic shelf label. The casing could comprise more than one pair of recesses to make it possible to secure further information display signs 40 to different positions around the electronic shelf label, and as an example the ESL illustrated in FIG. 1 comprises pairs of recesses arranged on all four sides of the casing such that one sign is attached to each of the four sides of the casing 11.

The recesses 30 extend within the shelf label casing 11 and ensure a resistant and strong fastening of an information display sign. The curved recesses 30 make it possible to attach information display signs 40 of different size and shape. Some different alternatives of signs are illustrated in FIGS. 1, 2, 3 and 4. The size and shape of the information display signs could be modified in a number of ways.

Each recesses comprises an opening 31 arranged in the respective side surface of the ESL 10 and a curved section 32 extending within the casing. In the illustrated embodiments the two recesses are arranged along a substantially straight line substantially parallel to the front side of the electronic shelf label. The curved recesses 32 extend in a plane substantially parallel to the front side of the electronic shelf label. The two recesses 30 are curved outwards, i.e. away from the other curved recess in the pair of recesses arranged in the same side of the casing. The curved shape results in that a reliable and strong securing of the information display sign 40 to the electronic shelf label. However, in an alternative configuration, illustrated in FIG. 4, the two recesses 30' could be curved towards each other.

In the illustrated embodiments of the electronic shelf label, pairs of curved recesses 30 arranged in the different sides of the casing to make it possible to attached further additional signs 40 to the electronic shelf label at the same time and consequently makes it possible to increase the additional area for displaying information.

The curvature of the recesses 30 could be modified in several different ways. One embodiment is illustrated schematically in FIGS. 1 and 2. This embodiment comprises a substantially rectangular opening 31 in the side surface of the casing 11. From the opening 31 a straight passage 33 extend parallel to the front and bottom and top side of the casing into the casing and then turns about 90° to form a transverse passage 34 parallel to the side where the opening in the casing is arranged such that a shoulder 35 is formed. The shoulder 35 could have a rectangular or rounded shape. This embodiment of the curved recess with the shoulder ensures that a sign could be reliably secured to the ESL. This embodiment of the recesses are curved away from the other recess but the transverse passage could also be arranged to curve towards the transverse passage of the other recess such that a corresponding shoulder is formed on side of the recess that is facing the other recess. In the casing illustrated in FIG. 2 the transverse passage extend all the way to the upper and lower sides of the casing but the transverse passage could also end within the casing.

As illustrated in FIGS. 1-3, there may be an arrangement comprising the electronic shelf label and the information display sign (40; 40'; 40") for use in combination with the electronic shelf label. The sign may, as previously disclosed, comprise an information display surface (41) surrounded by at least one circumferential edge (42; 42'; 42") and there may be at least two curved protrusions (45; 45'; 45") extending from said at least one circumferential edge. The protrusions may be arranged at a distance from each other corresponding to the distance between said at least two recesses in the electronic shelf label and may be of a shape corresponding to the curved recesses such that the sign could be secured to the electronic shelf label by arranging the two protrusions in the two recesses. In other words, the information display sign (40; 40'; 40") may be attached to the electronic shelf label by fitting the two protrusions of the sign in the two recesses of the electronic shelf label.

An alternative embodiment of the recess is illustrated in FIGS. 3*a* and 3*b* where the curved section 32' extending from the opening in the casing side has the shape of a circular arc that is extending away from the other recess. Also the shoulder 35'could be designed with a curvature. The circular arc shaped curved section 32' could however also be arranged such that recess 30' is curved towards the other recess.

Different embodiments of the information display sign 40 for use in combination with the electronic shelf label 10 are illustrated in FIGS. 1, 2, 3 and 4. Each sign 40 comprises an information display surface 41 that could be for example rectangular or circular. The display surface is, depending on the shape, surrounded by one, or more, circumferential edge 42 from which two curved protrusions 45 extend. The protrusions 45 are arranged at a distance from each other corresponding to the distance between said at least two recesses 30 in the electronic shelf label 10. The curved protrusions 45 have a shape corresponding to the curved recesses 30. 30' in the casing, i.e. the protrusions either has an arc shape or an L-shape, such that the sign 40 could be secured to the electronic shelf label by arranging the two protrusions in the corresponding two recesses 30, 30'.

The illustrated signs 40 are made of a sheet of a paper or plastic material that is slightly flexible such that the sign could be bent and/or the two curved protrusions 45 allowed to flex to facilitate the assembly of the sign to the electronic shelf label.

The assembly/disassembly of the embodiments of the sign illustrated in FIGS. 1, 2 and 3 is facilitated further by bending the sign to reduce the distance between the outer ends of the two protrusions to correspond to the distance between the openings in the electronic shelf label casing. The force is preferably applied in the plane of the sign to press the two protrusions towards each other which is illustrated with arrows in FIG. 2B. Once the two protrusions are fitted in the recesses the force applied is removed and the sign and the two protrusions returns to the original flat state an the protrusions are locked in the respective recess. Alternatively a force transverse to the plane of the sign is applied between the two protrusion such that the sign is forced to bend.

The information display surface 41 and the curved protrusions 45 are substantially flat and extending in a common plane intended to be arranged substantially parallel to the information display area on the electronic shelf label 10. The curved recesses 30, 30' have a width slightly larger than the thickness of the sheet of paper or plastic material to maintain the sign in the intended position to the electronic shelf label. The use of a sheet of material for the sign makes them easy and sheap to manufacture and ensures that the openings in the casing will have a limited area and the space required for the curved recesses within the casing is minimized.

The illustrated two protrusions 45 are curved outwards to fit in the illustrated recesses in the electronic shelf label. The sheet of plastic or paper material is slightly flexible and the sign, and protrusions, cut from the sheet such that the protrusions extend in the plane of the sheet. The shape of the protrusions 45 must correspond to the shape of the recesses 30, 30' and the shoulders 35, 35' formed in the different embodiments of the recesses to ensure the desired attachment of the sign to the casing.

The protrusions 45 extend in substantially parallel direction from the sign 40 at a distance from each other and has length, width and thickness corresponding to the length, width and thickness of the recesses in the ESL casing, i.e. the protrusions are slightly smaller to facilitate the assembly of the protrusions in the recesses.

The length of the protrusions could be extended to move the display surface away from the ESL as long as the outer end of the protrusions have a shape corresponding to the shape of the curved recesses in the ESL casing.

In FIG. 4 an alternative embodiment of the electronic shelf label and sign is illustrated to give an example of possible modifications of the claimed invention. In this embodiment the two curved recesses 30" have been arranged closer to each other and curved towards each other such that the transverse passages 34" are linked together and the shoulder 35" formed between the two curved passages 42". The curved protrusions 45" of the sign 40" are modified accordingly to engclos and grip the shoulder 35". This embodiment could be advantageous if the available space within the casing is limited.

In FIGS. 2, 3 and 4 the different embodiments of the electronic shelf label and the sign are illustrated in different positions before, during and after the sign is attached to the ESL. During assembly of the signs illustrated in FIGS. 2 and 3, one of the curved protrusions is first fitted in the intended position in the recess, i.e. the outer end of the protrusions is arranged to rest against the shoulder, and the flexible sign and protrusion flex to allow the other protrusion to slide into the curved recess. The embodiment illustrated in FIG. 4 is preferably pressed against the centrally arranged shoulder such that the two protrusions flex outwards to snap-fit around the shoulder.

The different embodiments described above could all be combined and modified in different ways without departing from the scope of the invention that is defined by the appended claims.

The invention claimed is:

1. Electronic shelf label for displaying information in combination with an information display sign, said electronic shelf label comprising:

a casing comprising at least one side surface, a front side and a back side;

an electronically-controlled information display area arranged in the front side;

at least two curved recesses arranged at a distance from each other in said at least one side surface, said at least two recesses are intended for attachment of the information display sign to the electronic shelf label, wherein the two recesses are arranged along a substantially straight line substantially parallel to the front side of the electronic shelf label, and said curved recesses extend in a plane substantially parallel to the front side;

the information display sign comprising:

an information display surface surrounded by at least one circumferential edge; and at least two curved protrusions extending from said at least one circumferential edge, said protrusions are arranged at a distance from each other corresponding to the distance between said at least two recesses in the electronic shelf label and has a shape corresponding to the curved recesses such that the sign could be secured to the electronic shelf label by arranging the two protrusions in the two recesses.

2. The electronic shelf label as defined in claim 1, wherein the two recesses comprises an opening arranged in the side surface and a curved section extending within the casing.

3. The electronic shelf label as defined in claim 1, wherein the two recesses are curved outwards.

4. The electronic shelf label according to claim 3, wherein the electronic shelf label comprises two curved recesses arranged in one or more of said first, second, upper or lower side.

5. The electronic shelf label as defined in claim 1, wherein the casing comprises a first side surface, a second side surface, an upper side and a lower side, and said two recesses are arranged in the first or second side surface.

6. The information display sign according to claim 1, wherein the sign is made of a sheet of a paper or plastic material.

7. The information display sign according to claim 1, wherein the information display surface and the curved protrusions are substantially flat and extending in a common plane intended to be arranged substantially parallel to the information display area on the electronic shelf label.

8. The information display sign according to claim 7, wherein the two protrusions are curved outwards such that the distance between the two recesses in the plane of the sign is increased along the protrusions.

9. An arrangement comprising:

an electronic shelf label comprising:

a casing comprising at least one side surface, a front side and a back side;

an electronically-controlled information display area arranged in the front side; and at least two curved recesses arranged at a distance from each other in said at least one side surface, said at least two recesses are intended for attachment of the information display sign to the electronic shelf label, wherein the two recesses are arranged along a substantially straight line substantially parallel to the front side of the electronic shelf label, and said curved recesses extend in a plane substantially parallel to the front side; and an information display sign for use in combination with the electronic shelf label, said sign comprising:

an information display surface surrounded by at least one circumferential edge;

and at least two curved protrusions extending from said at least one circumferential edge, said protrusions are arranged at a distance from each corresponding to the distance between said at least two recesses in the electronic shelf label and has a shape corresponding to the curved recesses such that the sign could be secured to the electronic shelf label by arranging the two protrusions in the two recesses.

* * * * *